US006870313B2

(12) United States Patent
Tramontana

(10) Patent No.: US 6,870,313 B2
(45) Date of Patent: Mar. 22, 2005

(54) ELECTROLUMINESCENCE SYSTEM AND DEVICE FOR THE PRODUCTION THEREOF

(75) Inventor: Michel Tramontana, Montefano (IT)

(73) Assignee: Filippo degli Azzoni Avogadro Carradori, Montefano (IT)

( * ) Notice: Subject to any disclaimer, the term of this patent is extended or adjusted under 35 U.S.C. 154(b) by 0 days.

(21) Appl. No.: 10/154,841

(22) Filed: May 28, 2002

(65) Prior Publication Data

US 2002/0190640 A1 Dec. 19, 2002

(30) Foreign Application Priority Data

May 25, 2001 (IT) ..... MC2001A0058
May 25, 2001 (IT) ..... MC2001A0059

(51) Int. Cl.[7] ..... H05B 33/12; H05B 33/22; H05B 33/02; H05B 33/10; H05B 33/26

(52) U.S. Cl. ..... 313/501; 313/110; 313/112; 313/498; 313/502; 313/506; 313/509

(58) Field of Search ..... 313/110, 112, 313/498, 500, 501, 502, 503, 506, 509

(56) References Cited

U.S. PATENT DOCUMENTS 4,670,355 A * 6/1987 Matsudaira ..... 313/509
6,099,979 A 8/2000 Inoguchi et al.
6,432,561 B1 * 8/2002 Yamazaki ..... 313/506
6,479,930 B1 * 11/2002 Tanabe et al. ..... 313/509

FOREIGN PATENT DOCUMENTS

| | | |
|---|---|---|
| EP | 0 386 312 A2 | 9/1990 |
| HU | 1636 U | 10/1999 |
| WO | 98/47321 | 10/1998 |
| WO | 00/16593 | 3/2000 |
| WO | 01/10173 A1 | 2/2001 |

* cited by examiner

*Primary Examiner*—Nimeshkumar D. Patel
*Assistant Examiner*—Sharlene Leurig
(74) *Attorney, Agent, or Firm*—Young & Thompson

(57) ABSTRACT

An electroluminescence system includes two electrodes, a dielectric layer with a pigment, another dielectric and, optional pigment layers, which are serially connected; a device for the production of an electroluminescence system including a dispensing roll and an applier roll carrying slots sized to the one of the strips forming the layers.

23 Claims, 5 Drawing Sheets

ELECTROLUMINESCENCE SYSTEM AND DEVICE FOR THE PRODUCTION THEREOF

FIELD OF THE INVENTION

This invention refers to a new electroluminescence system and to a device for producing the same.

BACKGROUND OF THE INVENTION

Electroluminescence is the so called Destriaut's effect. It is generally based on the layer principle. As it is possible to see in FIG. 1, according to the layer principle, a transparent film is the first electrode. It can be comprised of indium tin oxide 1, deposited on polyester 2. A light generating pigment is deposited on the second layer 3. An opaque insulator 4 is deposited on the pigment. A second electrode 5 is deposited on the insulator 4. The electroluminescence process can be divided into 4 steps: 1) tunnel emission of electrons from the interface between the electroluminescent composition and the surrounding dielectric; 2) acceleration of the high energy (1.5–10 eV) electrons in the electroluminescent composition; 3) impact excitation or impact ionisation of the luminescent centres; and photon emission through radiation due to the excitation and de-excitation process.

The behaviour of electroluminescent devices is very similar to the one of the capacitors and acts according to their laws. Two conductors separated by an insulator form a capacitor and its capacitance C is:

$$C=8.85\times10^{-12}\epsilon S/e \quad (1)$$

wherein C is capacitance in farad, $\epsilon$ is the dielectric constant, S is the area and e is the distance.

The amount of energy which can be charged by a capacitor is:

$$W=CE^2/2 \quad (2)$$

wherein W is energy in Joules, C is the capacitance in farad, E is the voltage.

Therefore, the amount of energy which can be charged depends more on the applied voltage than on capacitance. This voltage is limited by nature and thickness of the insulator, i.e., by the resistance of the dielectric. When voltage is over a certain threshold the dielectric has a failure between the conductors, which is due to an electric shortage arc. The parallel connection of several capacitors results in the value of the total capacitance being the sum of all capacitances:

$$C_t=C_1+C_2+C_3+\ldots+C_n \quad (3)$$

On the other hand, the serial connection of several capacitors results in the total capacitance being lower than the lowest capacitor of the sequence:

$$1/C_t=1/C_1+1/C_2+\ldots+1/C_n \quad (4)$$

Therefore, if there are a lot of elements alternately deposited in an electroluminescent system, they form in fact a lot of serially connected capacitors, so a lower capacitance results than in a single capacitance. However, when an electric field is applied which changes its polarity because it is fed by AC, all electroluminescent layers alternatively light up, with a phase shift, with the minimum energy required by electroluminescent composition, in order to produce light.

Furthermore, a capacitor with a solid dielectric is charged with DC and put in a small circuit for a few seconds. After opening the circuit, it is possible to observe that the capacitor has a new charge at its electrodes. Such a phenomenon derives from a partial absorption of the initial charge of the dielectric. Such an absorption and the restitution by the dielectric do not take place immediately, but depend on the nature of the dielectric, the time between absorption and restitution being submultiples of seconds to several hours.

In the case of the electroluminescent system, adding electroluminescent material increases such an absorption phenomenon, so that a charge build up occurs every phase of charge, notwithstanding the alternative current. Such a phenomenon can be described as a parasitic capacitance and creates problems when it is fed in high frequency.

Such an electroluminescent system has a life not long enough (up to 2,000 hours) and during this life, its brightness is rather low.

Nowadays, the only way to produce a luminescent system is serigraphy, which is a handicraft technique and has a low productivity.

SUMMARY OF THE INVENTION

It is object of the present invention an electroluminescent system, which solves the above referenced problems.

Furthermore, an additional object of the present invention is a device for the production thereof.

According to a first aspect, this invention refers to an electroluminescence system, comprising two electrodes and a dielectric layer with a pigment, characterised in that it further comprises other dielectric and, possibly, pigment layers.

Preferably, the further dielectric and possible pigment layer are serially connected.

According to a second aspect, this invention refers to a device for the production of an electroluminescence system, characterised in that it comprises a dispensing roll and an applier roll, the latter carrying slots the size of which corresponds to the one of the strips forming the layers.

BRIEF DESCRIPTION OF THE DRAWINGS

This invention is now described more in depth, referring to the accompanying drawings, wherein.

BEST WAY TO CARRY OUT THE INVENTION

Figure 1:
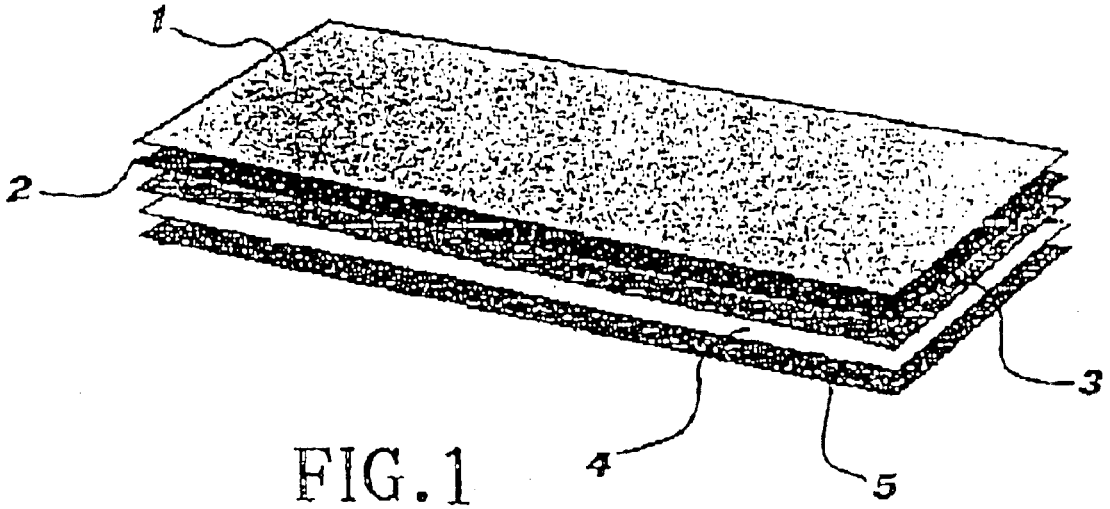
FIG. 1 PRIOR ART
FIG. 1 is an exploded view, schematically showing an electroluminescent system according to the prior art.

As it is possible to see in the drawings, this invention refers to a multi-layer system. A simple example of that is given in FIG. 2. As it can be seen therefrom, a film 6 of a conductor material, for instance indium tin oxide is deposited onto a translucent layer 7. Advantageously, the layer 7 is comprised of polyester. This makes the first electrode. Alternatively, the electrodes can be made by applying a conductive transparent paste or by sputtering a conductive substance.

A dielectric layer 8 contacts the layer 6. Also the dielectric 8 can be a translucent or a transparent material, but it is not limited thereto. On its other side, the dielectric layer 8 contacts a layer 9, carrying a light generating pigment. According to this invention, a second dielectric layer 10 lays under the layer 9: thus the layer 9 carrying the pigment which generates light is sandwiched between two dielectric layers 8 and 10. The layer 10 can be translucent or opaque. All the dielectric layers may be opaque. Finally, the layer 10 is deposited onto a second electrode 11.

Figure 3:
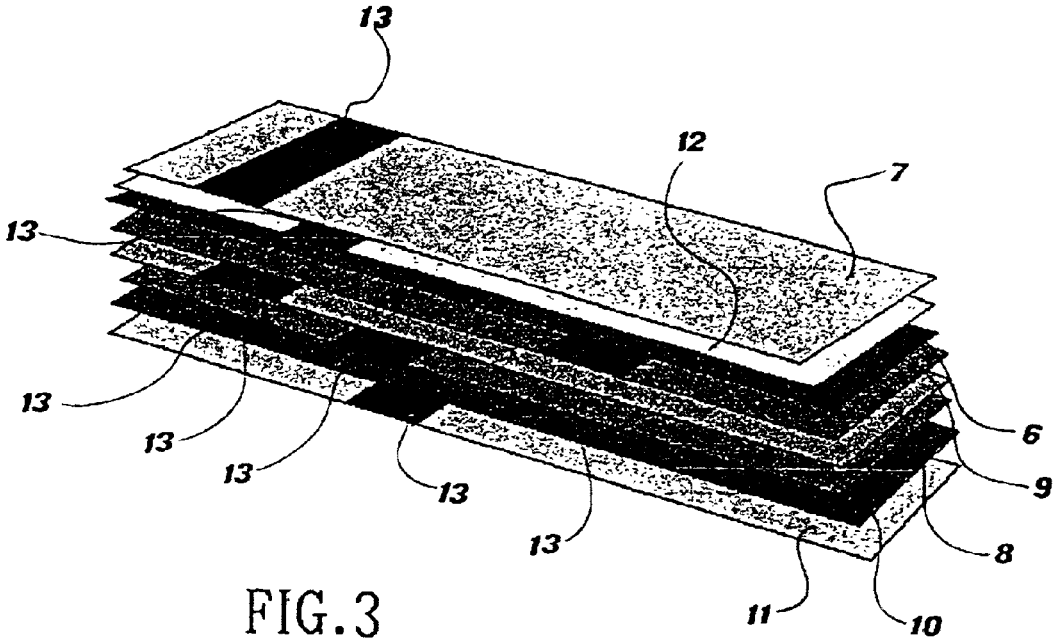
FIG. 3 is an alternative embodiment of the present invention, in a view similar to the previous ones.

A particular embodiment of the present invention is shown in FIG. 3. According to this embodiment, a reflector layer 12 is sandwiched between the conductive layer 6 and the translucent layer 7. This will enhance the light intensity, because of the reflection and concentration of the light to one side. Alternatively, the reflector can be simultaneously the conductor layer 6. Optionally, each layer can be provided with colour filter elements 13.

Figure 4:
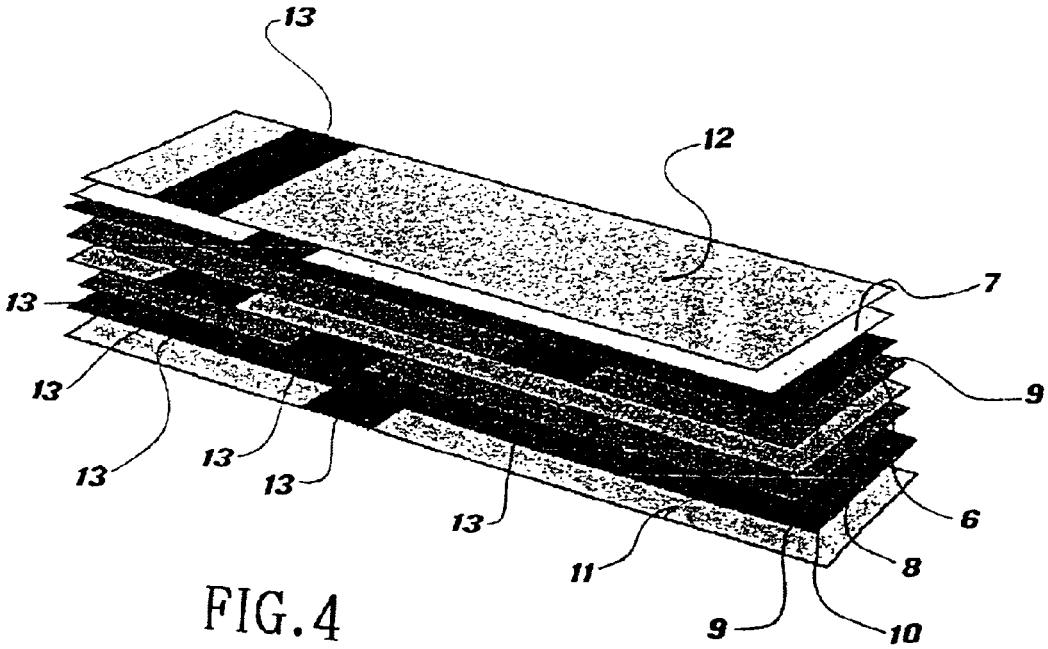
FIG. 4 is another alternative embodiment of this invention, in a view similar to the previous ones.

A similar embodiment is shown in FIG. 4, wherein the reflector layer 12 and the translucent layer 7 are reversed.

Figure 5:
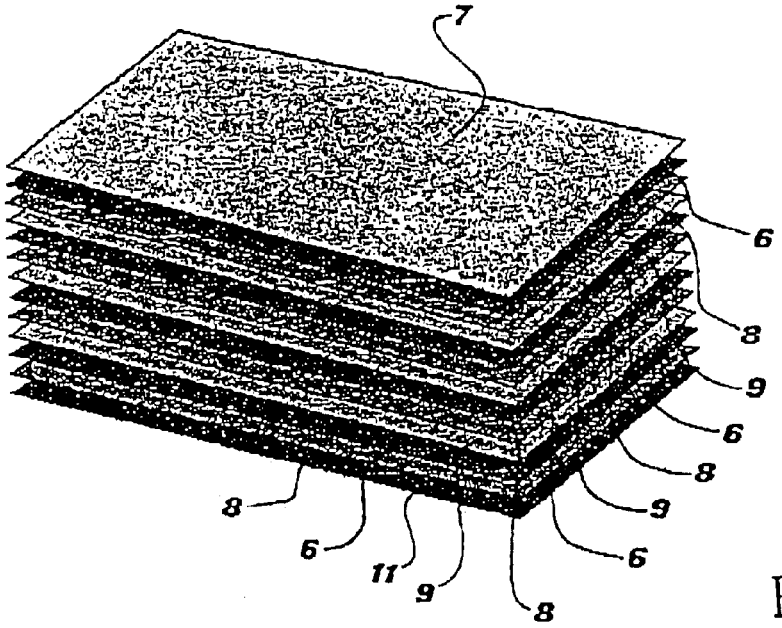
FIG. 5 is a schematic view of a multi-layer configuration.

FIG. 5 shows another preferred embodiment, which is comprised of a multi-layer pattern. As it is possible to see, a conductive layer 6 and a translucent layer 7 are coupled together. Then a translucent layer 7, a layer 9 containing a pigment generating light, and a dielectric layer 8 are alternated in a series. Finally, a second electrode 11 completes the electroluminescent device.

Figure 6:
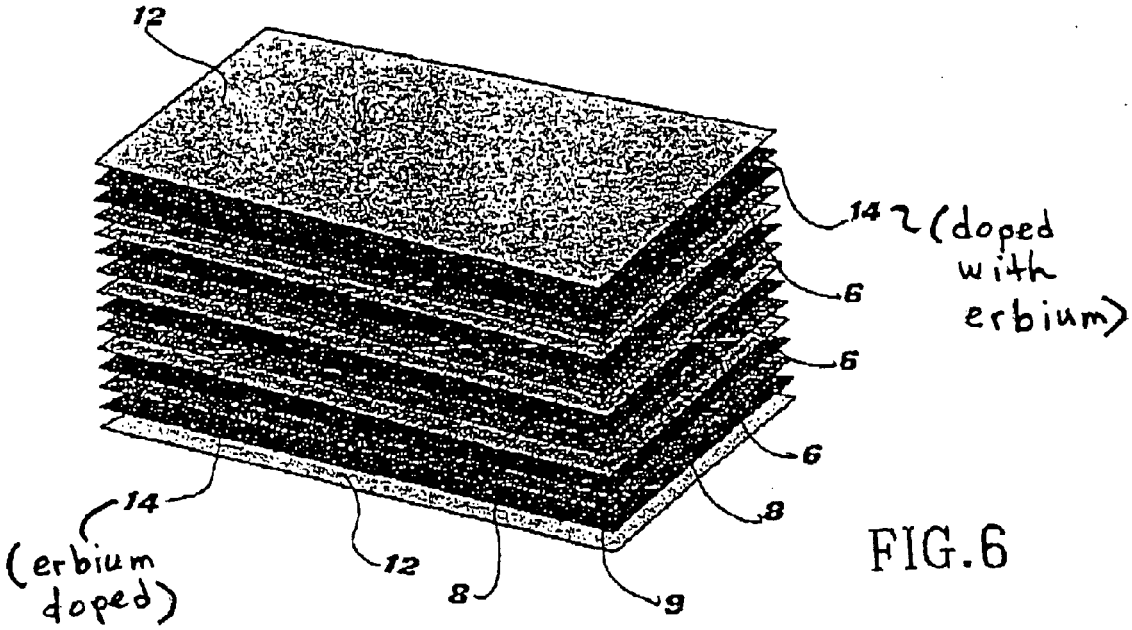
FIG. 6 is an embodiment, useful for the light amplification.

FIG. 6 shows a similar arrangement. Moreover, the arrangement of FIG. 6 comprises two reflector layers 12, in external position. The reflector layers 12 contact respective transparent layers 14, which are doped with erbium. Optionally (but it is not shown in the drawings) the layers can be provided with colour filters.

Figure 8:
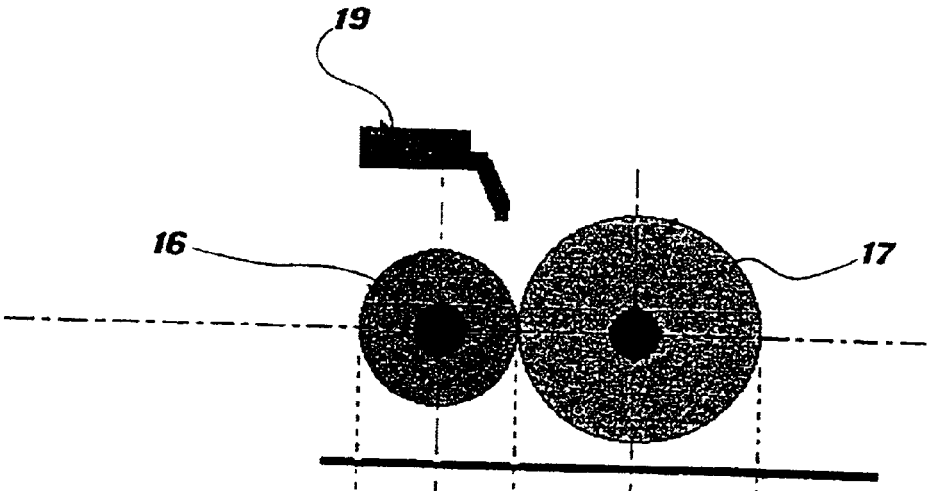
FIG. 8 is a cross section view, taken along the track VIII—VIII of FIG. 7.
Figure 7:
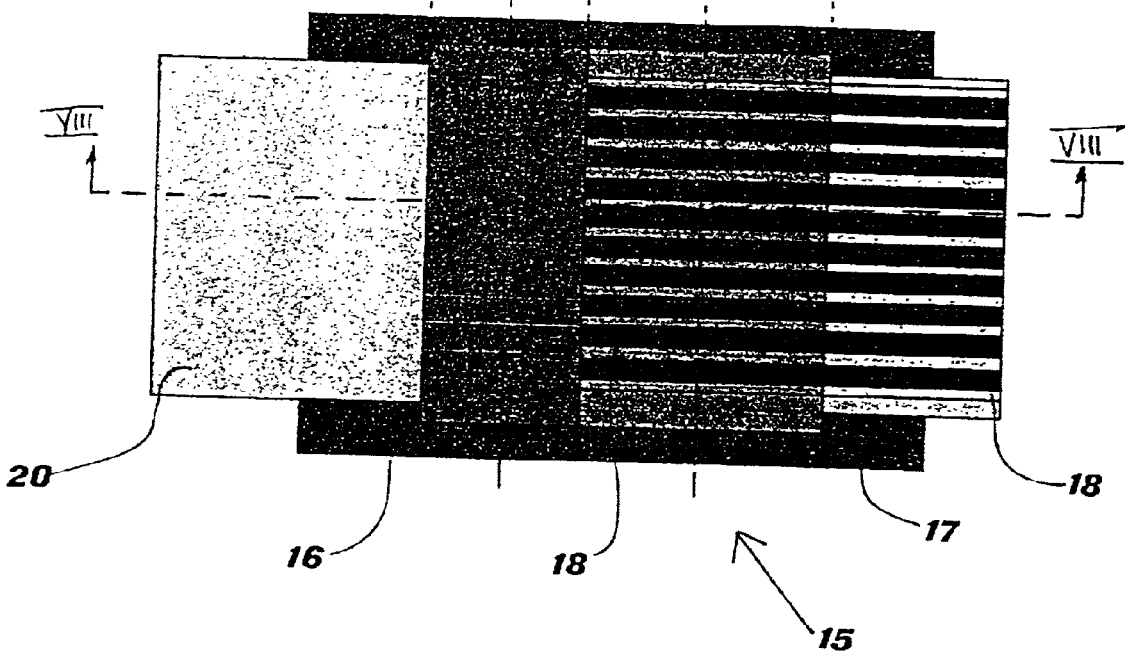
FIG. 7 is a plan view of an inventive device for producing electroluminescent systems.

FIG. 7 shows a plan view and FIG. 8 a cross-section of a device 15 for the production of electrolumiscence systems according to the present invention. In contrast with the prior devices, the device 15 allows a perfect automation of the process. The device includes a dispensing roll 16 and an applier roll 17. The applier roll 17 has a number of slots 18, the size of which corresponds to the size of the layers to be produced. The roll surfaces are treated with special materials, which are able to give a perfect adherence of the substances to be applied onto the different layers.

The device comprises also a dispenser 19, which cooperates with the dispensing roll 16. A layer 20, onto which the electroluminescent layers are to be applied, can be continuously introduced under the rolls 16, 17.

Figure 9:
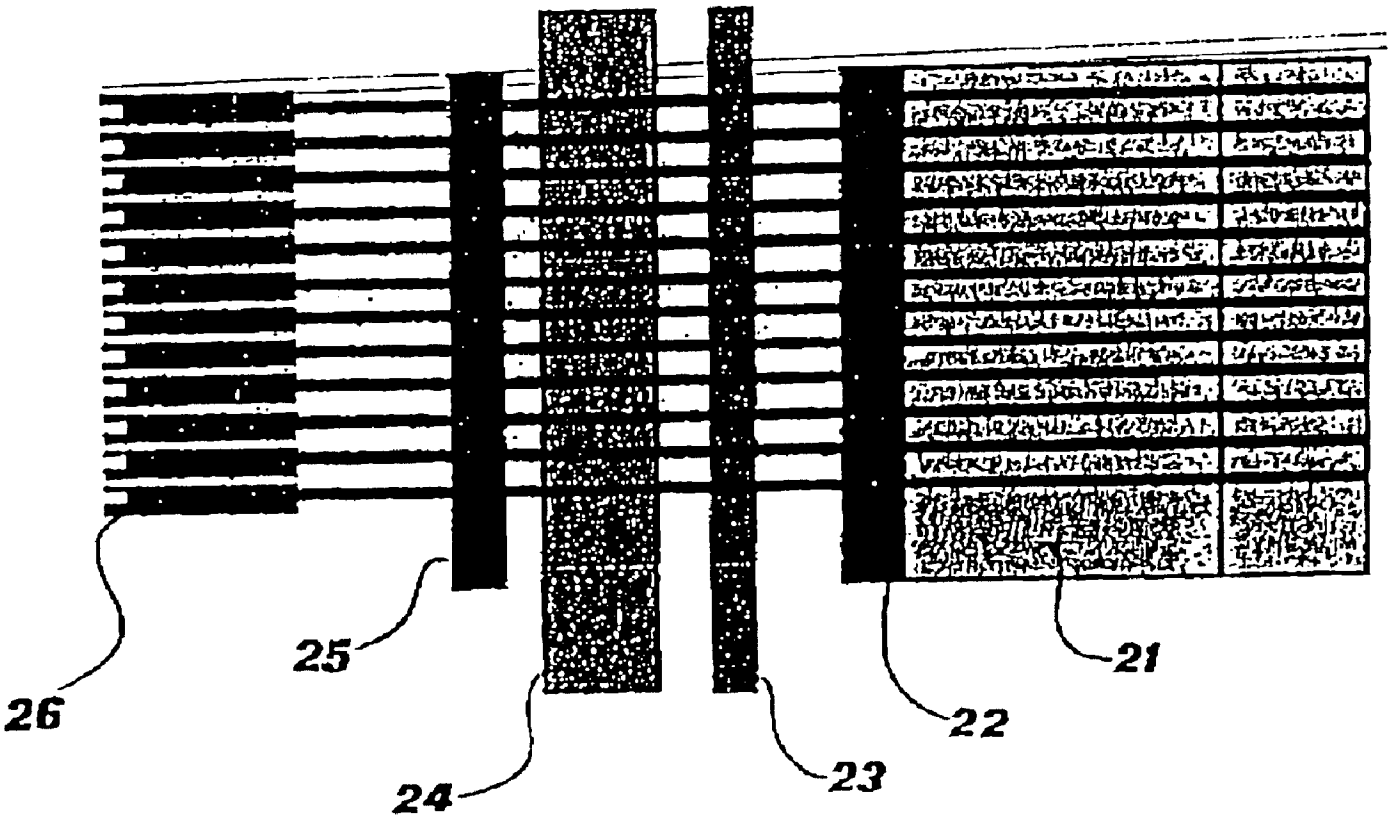
FIG. 9 is a schematic diagram, illustrating a process of production of an electroluminescent system.

The part of the device carrying out the subsequent part of the process is shown in FIG. 9. 21 indicates the product coming out from the part of the device shown in FIGS. 7 and 8. 22 is a blade. 23 is a dispenser of conductor layers. 24 is a laminating unit. 25 is another blade. Finally, 26 is the roll collecting the obtained strips.

Figure 2:
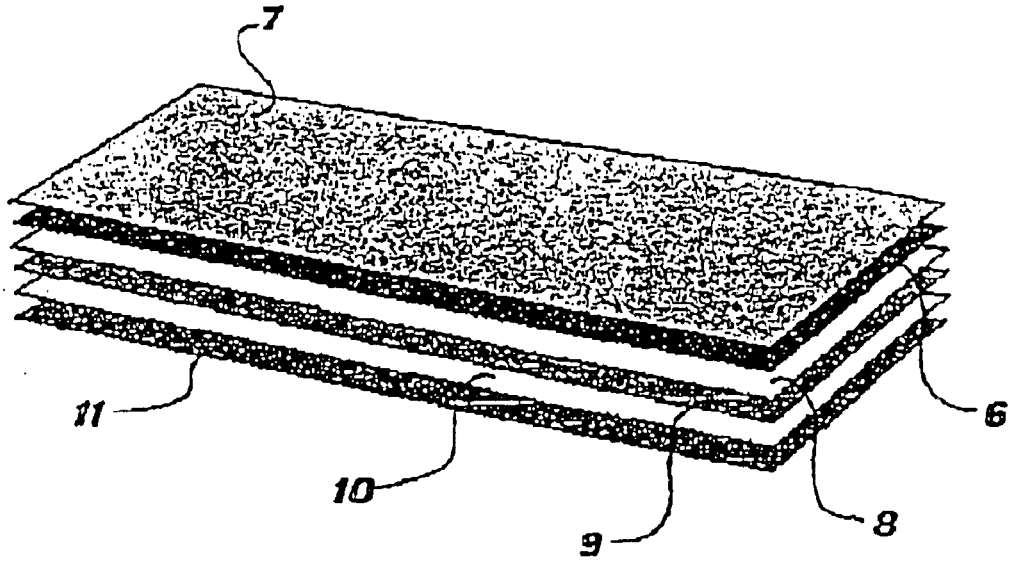
FIG. 2 is an exploded view, similar to FIG. 1, schematically showing an electroluminescent system according to this invention.

The configuration of the inventive electroluminescence system can be chosen according to the particular use. The pattern in FIG. 2 is the most simple, but it is in any case much more powerful than the conventional ones, since the parasite capacitance is minimised [see eq. (4) above].

The particular configurations of FIG. 3 and of FIG. 4 allow to increase, through the reflector layer, the light intensity, since a reflection and a concentration of the light to a side arises. The reflector layer can be used also as a substrate layer. The colour filter allows to give particular, desired chromatic effects.

As it has been seen, FIG. 5 shows a multi-layer pattern. The higher the number of layers; the higher the light intensity. Of course, increasing the number of layers results in a higher production cost. In any case, the power consumption with this pattern is very low and the life of these systems is very long.

The embodiment of FIG. 6 includes layers 14, which are transparent and doped with erbium. The layers 14 stimulate the photons which cross them, so as to amplify the emitted light. For this to happen, it is necessary to employ also reflector layers 12, which reflect the amplified light, so as to give a very strong effect. This is due to a resonance mechanism, which oscillates the photons until they are emitted. Colour filters can be also provided.

The above described electroluminescence systems can be employed in a variety of applications, for instance in displays, for displays on PCB's, for television colour screens (for instance for high definition, very large screens).

Another use for which the inventive electroluminescence system can be used is for producing a stiff structure wherein the said electroluminescence system is inserted for a lighting device, like a sort of "lighting brick".

The layer 20 onto which the layers are to be coupled is continuously fed into the device 15. The dispenser 19 feeds the particular substance to be applied to the dispensing roll 16. While the layer 20 goes on, it arrives under the applier roll 17, onto which the dispensing roll 16 pours the substance. Due to its slots 18, the roll 17 applies the substances to the layer 20 with a size very similar to the ones of the final system.

The so prepared product 21 is fed to the second part of the process. A blade 22 performs the coarse cutting of the strips. Then layers receive their conductor layers, completing the device, from the dispenser 23. Subsequently, the prepared layers are laminated in 24, so as to form the final system, which is finely cut by the blade 25. The roll 26 wraps all systems in a wheel.

It is apparent that this invention offers a lot of advantages. The electroluminescence system of this invention can be manufactured very easily and continuously, so as to spare very high costs. Furthermore, the low capacitance of the system allows one to reduce the electric charge and, accordingly, the anti-resonance phenomenon is limited. Also the power consumption due to absorption phenomena is minimised. The conversion of electric power into light is very effective (more than 80%). The combined layers simultaneously emit added light. The life period of these systems is by far longer than the conventional one, due to the reduced frequency.

The electroluminescence system of the present invention can be produced with the device of the present invention, but it is not limited thereto, the conventional process being also suitable, although less advantageous.

What is claimed is:

1. An electroluminescence system, comprising two electrodes (7, 11) and a dielectric layer (8) with a pigment layer (9), characterised in that it further comprises a further dielectric layer (10) and, possibly, further pigment (9) layers, characterised in that each layer is provided with a colour filter (13).

2. An electroluminescence system as claimed in claim 1, characterised in that the further dielectric layer (10) is serially connected to a pigment (9) layer.

3. An electroluminescence system as claimed in claim 2, characterised in that the electrodes comprise a film (6) of a conductor material deposited onto a translucent layer (7).

4. Electroluminescence system as claimed in claim 3, characterised in that the translucent layer (7) is comprised of polyester.

5. Electroluminescence system as claimed in claim 2, characterised in that said electrodes (7, 11) are produced by means of a translucent or transparent conductive element.

6. An electroluminescence system, comprising two electrodes (7, 11) sandwiching two luminescence layers, the first luminescence layer comprising a first dielectric layer (8) and a first pigment layer (9), the second luminescence layer comprising a second dielectric layer (10) and a second pigment layer (9), and each of the first and second luminescence layers comprising a color filter (13).

7. Electroluminescence system as claimed in claim 5, characterised in that the said conductive element is a sputtered conductive substance forming a film (6) of a conductor material.

8. Electroluminescence system as claimed in claim 7, characterised in that the film (6) of the conductor material is comprised of indium tin oxide.

9. Electroluminescence system as claimed in claim 1, characterised in that the dielectric layer (8) is a translucent or a transparent material.

10. Electroluminescence system as in claim 1, characterised in that the pigment layer (9) is sandwiched between two dielectric layers (8, 10).

11. Electroluminescence system as in claim 1, characterised in that the dielectric layers are translucent.

12. Electroluminescence system as in claim 1, characterised in that the dielectric layers are opaque.

13. Electroluminescence system as in claim 3, characterised in that a reflector layer (12) is sandwiched between the conductor layer and the translucent layer.

14. Electroluminescence system as in claim 3, characterised in that a reflector (12) and the translucent layer sandwich the conductor layer.

15. Electroluminescence system as in claim 1, wherein a conductor layer of one of the electrodes is a reflector.

16. Electroluminescence system as in claim 1, further comprising:

two reflector layers (12) contacting respective transparent layers doped with erbium.

17. An electroluminescence system, comprising:

two electrodes (7, 11) in vertical registration;

a first dielectric layer (8) with a pigment (9) layer;

the first dielectric layer comprising a first color filter (13); and a second dielectric layer (10);

the second dielectric layer comprising a second color filter (13);

the first and second dielectric layers and the first and second color filters being vertically intermediate the two electrodes.

18. The system of claim 17, wherein the second dielectric layer has an applied pigment layer.

19. The system of claim 17, further comprising:

a reflector layer (12) adjacent one of the two electrodes.

20. The system of claim 17, wherein one of the two electrodes comprises a transparent film (7) and a conductive film (6).

21. The system of claim 20 wherein one of the two electrodes comprises a transparent film (7) and a conductive film (6), and further comprising a reflector layer (12) adjacent the transparent film.

22. The system of claim 17, wherein the first and second color filters are vertically offset from each other.

23. An electroluminescence system, comprising:

a first electrode with a first outer perimeter;

a second electrode in vertical registration with the first electrode; and plural electrically serially connected luminescence layers vertically stacked intermediate the first and second electrodes, wherein, the plural luminescence layers comprise at least;

a first dielectric layer contacting a first pigment layer; and a second dielectric layer contacting a second pigment layer;

the system is free of any further electrodes vertically located between the first and second electrodes, wherein each of the luminescence layers comprises a color filter.

* * * * *

UNITED STATES PATENT AND TRADEMARK OFFICE

CERTIFICATE OF CORRECTION

PATENT NO. : 6,870,313 B2
APPLICATION NO. : 10/154841
DATED : March 22, 2005
INVENTOR(S) : Michel Tramontana It is certified that error appears in the above-identified patent and that said Letters Patent is hereby corrected as shown below:

On the cover page, Item (73), should read as follows:

--(73) Assignee: Filippo degli Azzoni Avogadro Carradori, Montefano (IT) (50% interest)--.

Signed and Sealed this

Thirteenth Day of February, 2007

JON W. DUDAS
*Director of the United States Patent and Trademark Office*